US009470020B2

(12) United States Patent
Eto

(10) Patent No.: US 9,470,020 B2
(45) Date of Patent: Oct. 18, 2016

(54) COVER OPENING/CLOSING DEVICE AND IMAGE FORMING APPARATUS INCLUDING THIS

(71) Applicant: KYOCERA Document Solutions Inc., Osaka (JP)

(72) Inventor: Daisuke Eto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/853,207

(22) Filed: Sep. 14, 2015

(65) Prior Publication Data

US 2016/0083979 A1 Mar. 24, 2016

(30) Foreign Application Priority Data

Sep. 22, 2014 (JP) ..... 2014-192193

(51) Int. Cl.
*G03G 21/16* (2006.01)
*E05B 65/00* (2006.01)

(52) U.S. Cl.
CPC ..... *E05B 65/006* (2013.01); *G03G 21/1623* (2013.01); *G03G 21/1633* (2013.01); *G03G 2221/169* (2013.01); *G03G 2221/1654* (2013.01)

(58) Field of Classification Search
CPC ..... G03G 21/1633; E05C 1/08; E05C 1/085; E05C 1/166; E05B 65/006
See application file for complete search history.

(56) References Cited

U.S. PATENT DOCUMENTS 4,509,347 A * 4/1985 Young ..... E05B 47/0002 292/140
5,496,078 A * 3/1996 Yasuda ..... E05C 1/08 292/165

(Continued)

FOREIGN PATENT DOCUMENTS

| | | | |
|---|---|---|---|
| CN | 203338195 | U | 12/2013 |
| JP | 2001-329732 | A | 11/2001 |
| JP | 2009-122397 | A | 6/2009 |

OTHER PUBLICATIONS

Machine translation of Japanese Patent Document JP2009-122397. Jun. 4, 2009.*

(Continued)

*Primary Examiner* — David Gray
*Assistant Examiner* — Carla Therrien
(74) *Attorney, Agent, or Firm* — Studebaker & Brackett PC

(57) ABSTRACT

A cover opening/closing device includes an engage mechanism and a lock mechanism. The engage mechanism is provided in an apparatus body. The lock mechanism is provided in a cover. The lock member includes a button, a lock member, and an interlocking mechanism. The button is provided to be able to move linearly. The lock member is provided to be able to move linearly between a lock position and an unlock position. The interlocking mechanism interlocks a movement of the button with a movement of the lock member. The interlocking mechanism includes a return member, an oblique groove, and a projection part. The return member returns the button to an initial position. The projection part fits movably along the oblique groove. The oblique groove guides a relative movement of the projection part so as to interlock an operation of the button with a movement of the lock member.

6 Claims, 9 Drawing Sheets

(56) References Cited

U.S. PATENT DOCUMENTS 6,048,001 A * 4/2000 Miller ..... E05B 1/0038 292/194
7,726,705 B2 * 6/2010 Kim ..... B60N 3/083 292/163
8,726,704 B2 * 5/2014 White ..... E05B 37/20 109/48
8,756,963 B2 * 6/2014 Le ..... E05C 1/14 292/169
2005/0002685 A1 * 1/2005 Okamura ..... G03G 15/0855 399/110
2007/0120376 A1 * 5/2007 Bella ..... E05B 83/30 292/163
2008/0063430 A1 * 3/2008 Nobuoka ..... G03G 21/1633 399/124
2010/0329730 A1 * 12/2010 Fujita ..... G03G 21/185 399/110
2014/0353902 A1 * 12/2014 Okabe ..... B65H 5/26 271/3.19

OTHER PUBLICATIONS

The extended European search report issued by the European Patent Office on Feb. 23, 2016, which corresponds to European Patent Application No. 15184983.3-1568 and is related to U.S. Appl. No. 14/853,207.

* cited by examiner

COVER OPENING/CLOSING DEVICE AND IMAGE FORMING APPARATUS INCLUDING THIS

INCORPORATION BY REFERENCE

This application is based on and claims the benefit of priority from Japanese Patent application No. 2014-192193 filed on Sep. 22, 2014, the entire contents of which are incorporated herein by reference.

BACKGROUND

The present disclosure relates to a cover opening/closing device open and close a cover turnably supported by an apparatus body and to an image forming apparatus including this.

Some apparatus body (housing) of an electronic device such as an image forming apparatus is provided with a cover opened/closed in replacing a consumable component and in implementing various maintenances.

For instance, there is known a cover opening/closing mechanism including a button movable linearly in a vertical direction with respect to an appearance surface of a cover, a lock member sliding in a direction in parallel with the appearance surface in linkage with the linear movement of the button, a first compression spring returning the button to its initial position, and a second compression spring compressed between the lock member and the cover. The lock member is biased in a direction of being locked by an engage part of the apparatus body by the second compression spring. This cover opening/closing mechanism is configured such that the lock member slides and is unlocked by resisting against a bias force of the first compression spring when the button is depressed by resisting against the bias force of the first compression spring.

However, the abovementioned cover opening/closing mechanism is required to dispose the second compression spring to bias the lock member toward the engage part, incurring enlargement and complication of the mechanism. Due to that, the abovementioned cover opening/closing mechanism has a problem that it cannot be adopted for an electronic device which is required to be downsized.

SUMMARY

According to one aspect of the present disclosure, a cover opening/closing device includes an engage mechanism and a lock mechanism. The engage mechanism is provided in either one of the apparatus body and a cover turning centering a turning shaft with respect to the apparatus body. The lock mechanism is provided in either other one of the apparatus body and the cover.

The lock member includes a button, a lock member, and an interlocking mechanism. The button is provided to be able to move linearly in a normal line direction of an appearance surface of either other one of the apparatus body and the cover. The lock member is provided to be able to move linearly in a direction in parallel with the appearance surface between a lock position where the lock member is engagable with the engage mechanism and an unlock position where the lock member is disengaged. The interlocking mechanism interlocks a movement of the button with a movement of the lock member. The interlocking mechanism includes a return member, an oblique groove, and a projection part. The return member returns the button to an initial position. The oblique groove is provided at either one of the button and the lock member and extends obliquely with respect to the normal line of the appearance surface. The projection part is provided in either other one of the button and the lock member and fits movably along the oblique groove.

The oblique groove guides a relative movement of the projection part so as to interlock a pressing operation of the button located at the initial position with a movement of the lock member heading to the unlock position and guides a relative movement of the projection part so as to interlock a return operation of the button caused by the return member with a movement of the lock member heading to the lock position.

According to one aspect of the present disclosure, an image forming apparatus includes an image forming part performing an image forming process; and a cover opening/closing device.

The cover opening/closing device includes an engage mechanism and a lock mechanism. The engage mechanism is provided in either one of the apparatus body and a cover turning centering a turning shaft with respect to the apparatus body. The lock mechanism is provided in either other one of the apparatus body and the cover.

The lock member includes a button, a lock member, and an interlocking mechanism. The button is provided to be able to move linearly in a normal line direction of an appearance surface of either other one of the apparatus body and the cover. The lock member is provided to be able to move linearly in a direction in parallel with the appearance surface between a lock position where the lock member is engagable with the engage mechanism and an unlock position where the lock member is disengaged. The interlocking mechanism interlocks a movement of the button with a movement of the lock member. The interlocking mechanism includes a return member, an oblique groove, and a projection part. The return member returns the button to an initial position. The oblique groove is provided at either one of the button and the lock member and extends obliquely with respect to the normal line of the appearance surface. The projection part is provided in either other one of the button and the lock member and fits movably along the oblique groove.

The oblique groove guides a relative movement of the projection part so as to interlock a pressing operation of the button located at the initial position with a movement of the lock member heading to the unlock position and guides a relative movement of the projection part so as to interlock a return operation of the button caused by the return member with a movement of the lock member heading to the lock position.

The above and other objects, features, and advantages of the present disclosure will become more apparent from the following description when taken in conjunction with the accompanying drawings in which a preferred embodiment of the present disclosure is shown byway of illustrative example.

DETAILED DESCRIPTION

In the following, a preferable embodiment of the present disclosure will be described with reference to the appended drawings.

Figure 1:
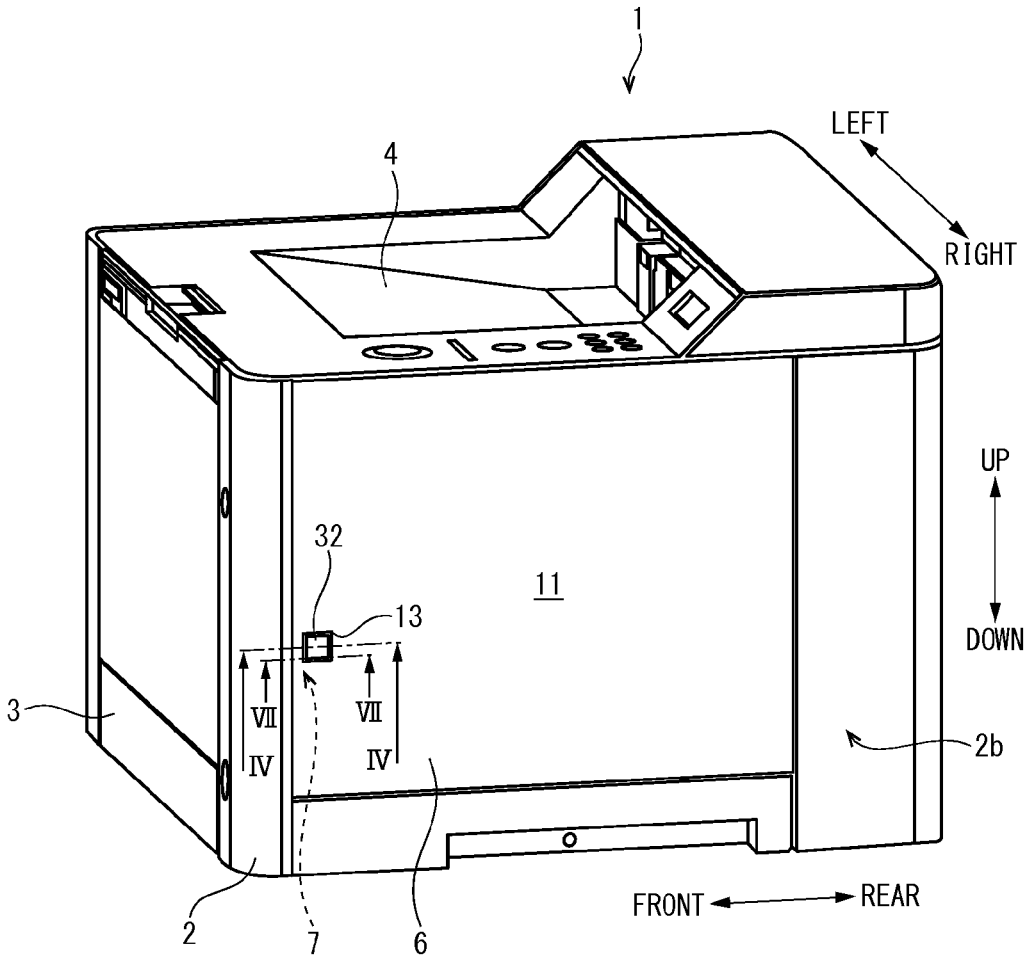
FIG. 1 is a perspective view illustrating a color printer according to one embodiment of the present disclosure.
Figure 2:
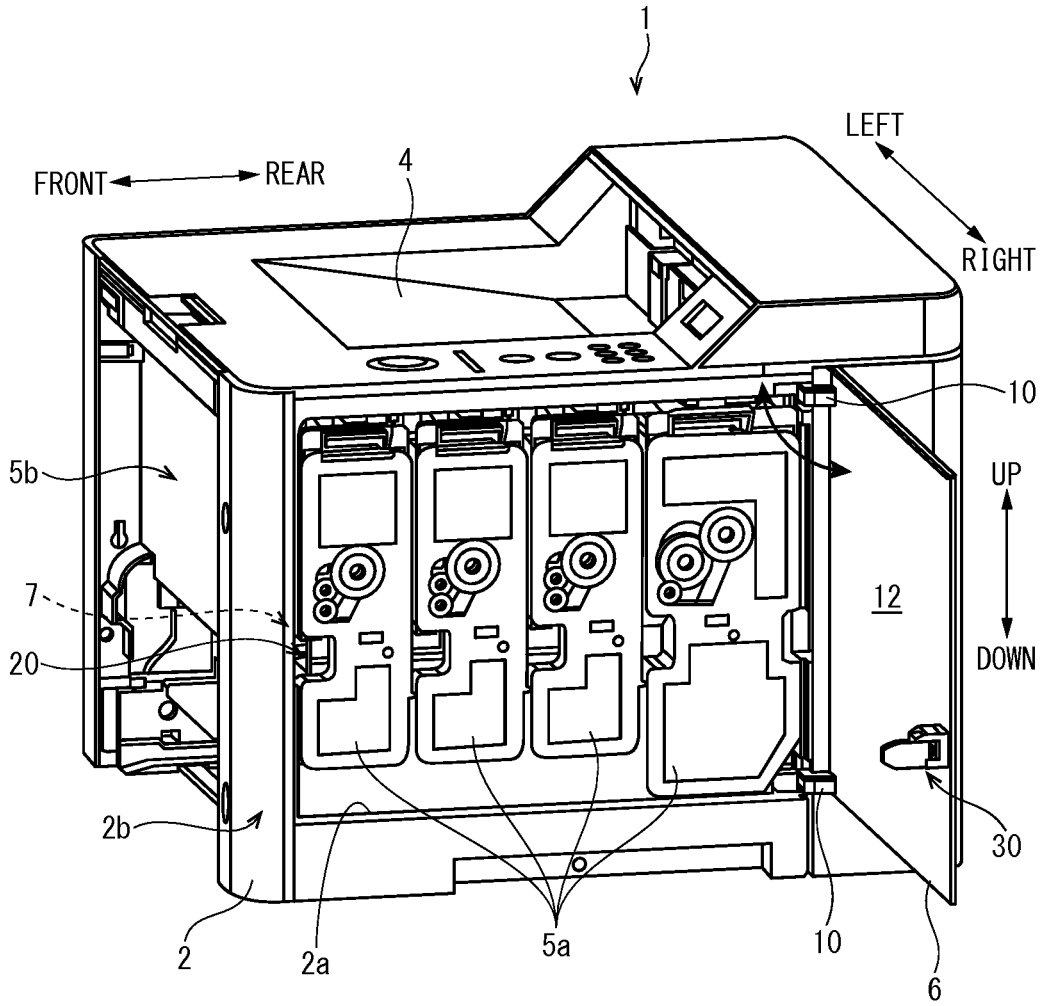
FIG. 2 is a perspective view illustrating a state in which a cover of the color printer of one embodiment of the present disclosure is opened.

An entire configuration of a color printer 1, i.e., an image forming apparatus, will be described with reference to FIGS. 1 and 2. FIG. 1 is a perspective view illustrating the color printer 1, and FIG. 2 is a perspective view illustrating a state in which a cover 6 of the color printer 1 is opened. It is noted that directions are indicated appropriately in each drawing in the following description.

As shown in FIG. 1, the color printer 1 includes an apparatus body 2, a sheet feed cassette 3 and a discharge tray 4. The apparatus body 2 is formed substantially into a shape of a rectangular box. The sheet feed cassette 3 is provided at a lower part of the apparatus body 2. The discharge tray 4 is provided on an upper surface of the apparatus body 2.

As shown in FIG. 2, a container replacing opening 2*a* formed into a rectangular shape in side view is provided on a right side surface of the apparatus body 2. Arrayed in a front-rear direction within the container replacing opening 2*a* are four toner containers 5*a*. The four toner containers 5*a* contain four color toners (developer), respectively.

Disposed within the apparatus body 2 is an image forming part 5*b* including the four toner containers 5*a*. The image forming part 5*b* performs an image forming process by means of a known electro-photographic system by using the four color toners onto a sheet (not shown) conveyed from the sheet feed cassette 3 through a conveying path (not shown). The sheet on which an image has been formed is conveyed further downstream of the conveying path and is discharged out of the apparatus body 2 to the discharge tray 4.

As shown in FIGS. 1 and 2, a cover 6 for opening and closing the container replacing opening 2*a* is provided on the right side surface of the apparatus body 2. The cover 6 is formed into a rectangular plate by a synthetic resin for example. The cover 6 is configured to turn substantially horizontally centering on a pair of upper and lower turning shafts 10. The cover 6 constitutes a right side surface of the apparatus body 2 as it closes the container replacing opening 2*a* (see FIG. 1). That is, an outer surface 11 of the cover 6 is substantially flush with an outer surface 2*b* of the apparatus body 2 composing an outer peripheral edge part of the container replacing opening 2*a*. Meanwhile, the respective toner containers 5*a* are exposed by opening the cover 6 of the container replacing opening 2*a* (see FIG. 2). That is, the respective toner containers 5*a* can be replaced by opening the cover 6.

The apparatus body 2 and the cover 6 are provided with a cover opening/closing device 7. The cover opening/closing device 7 is provided to conduct opening and closing operations of the cover 6.

Figure 3:
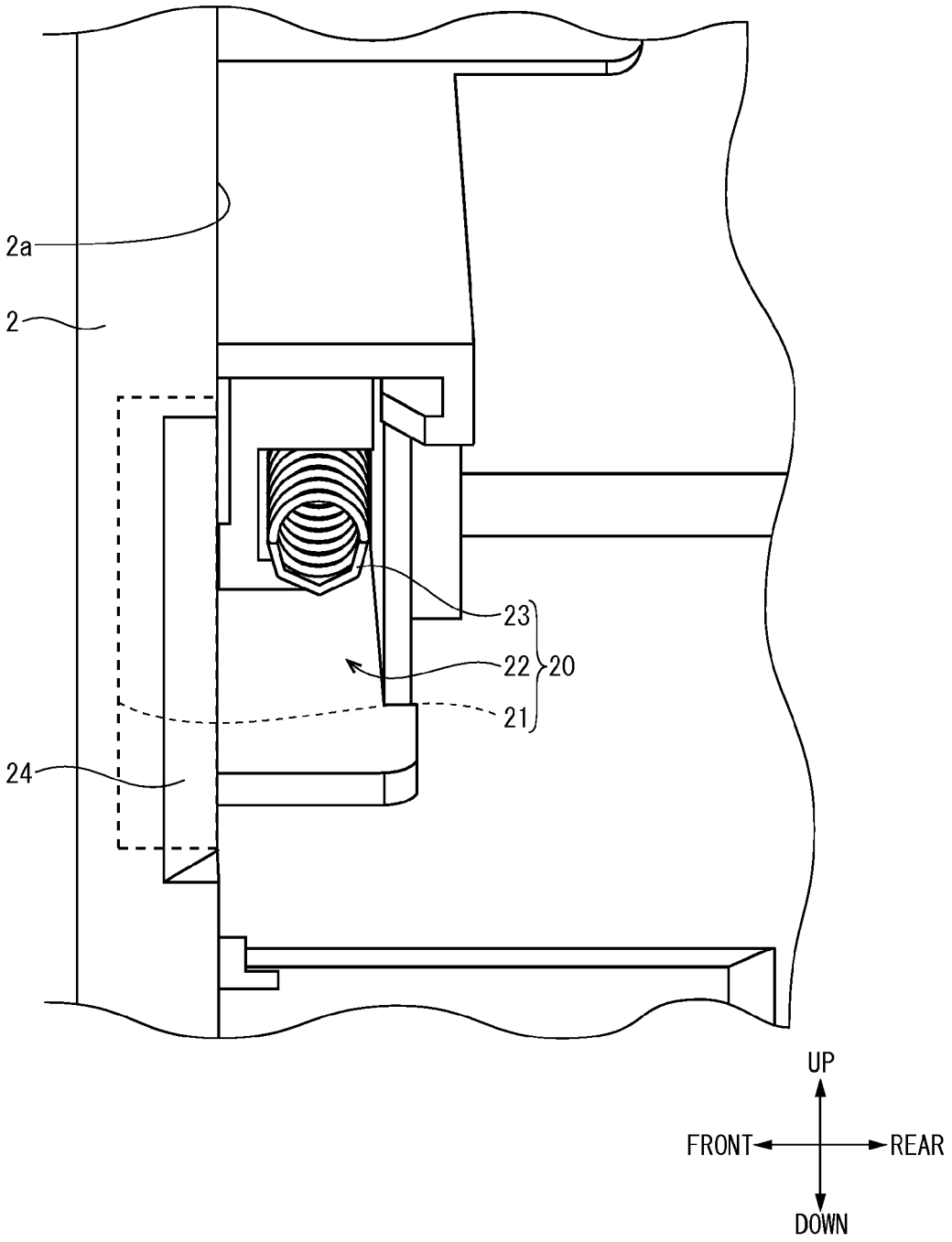
FIG. 3 is a perspective view illustrating an engage mechanism of a cover opening/closing device of one embodiment of the present disclosure.
Figure 4:
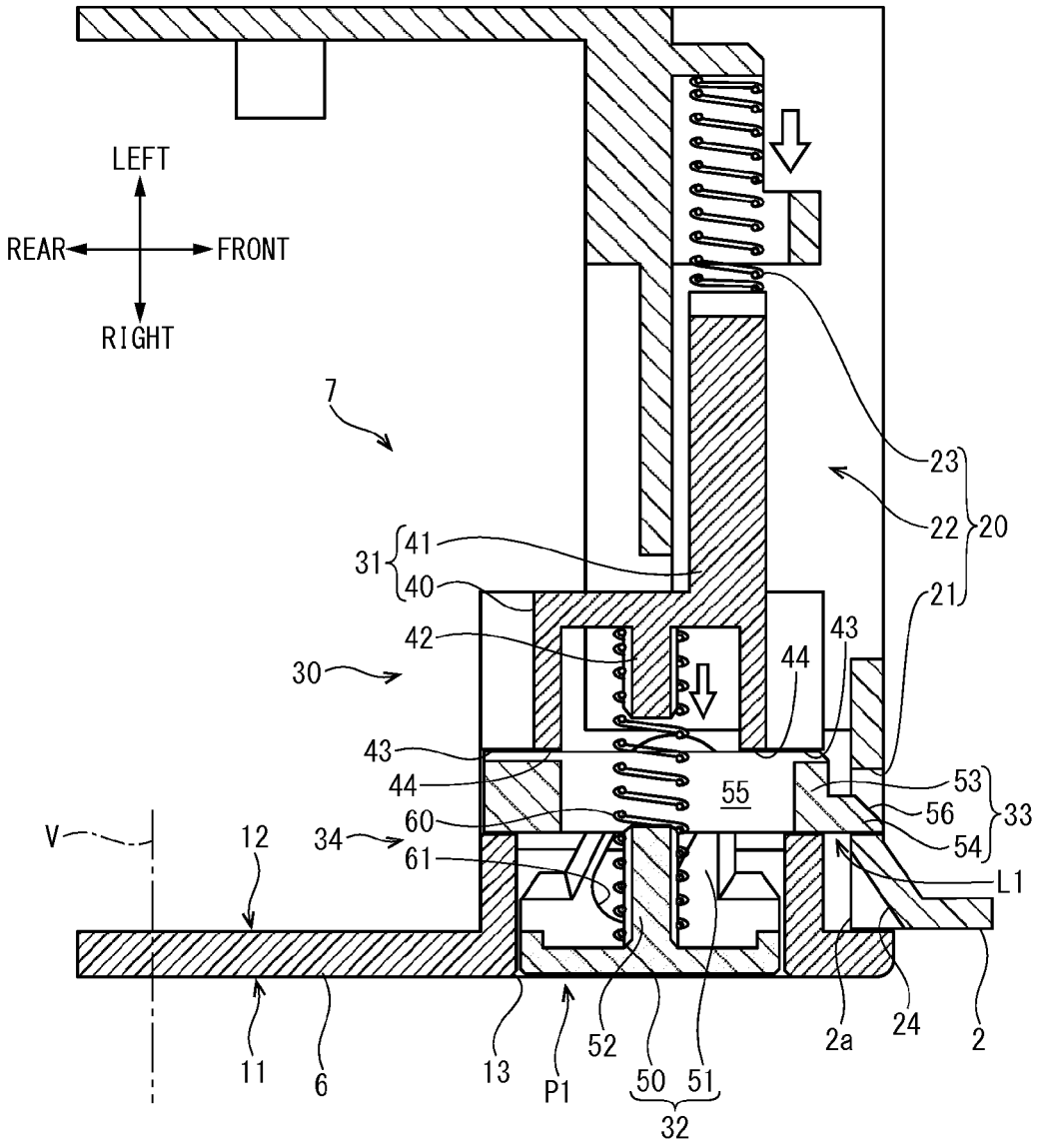
FIG. 4 is a section view taken along a line IV-IV in FIG. 1.
Figure 5:
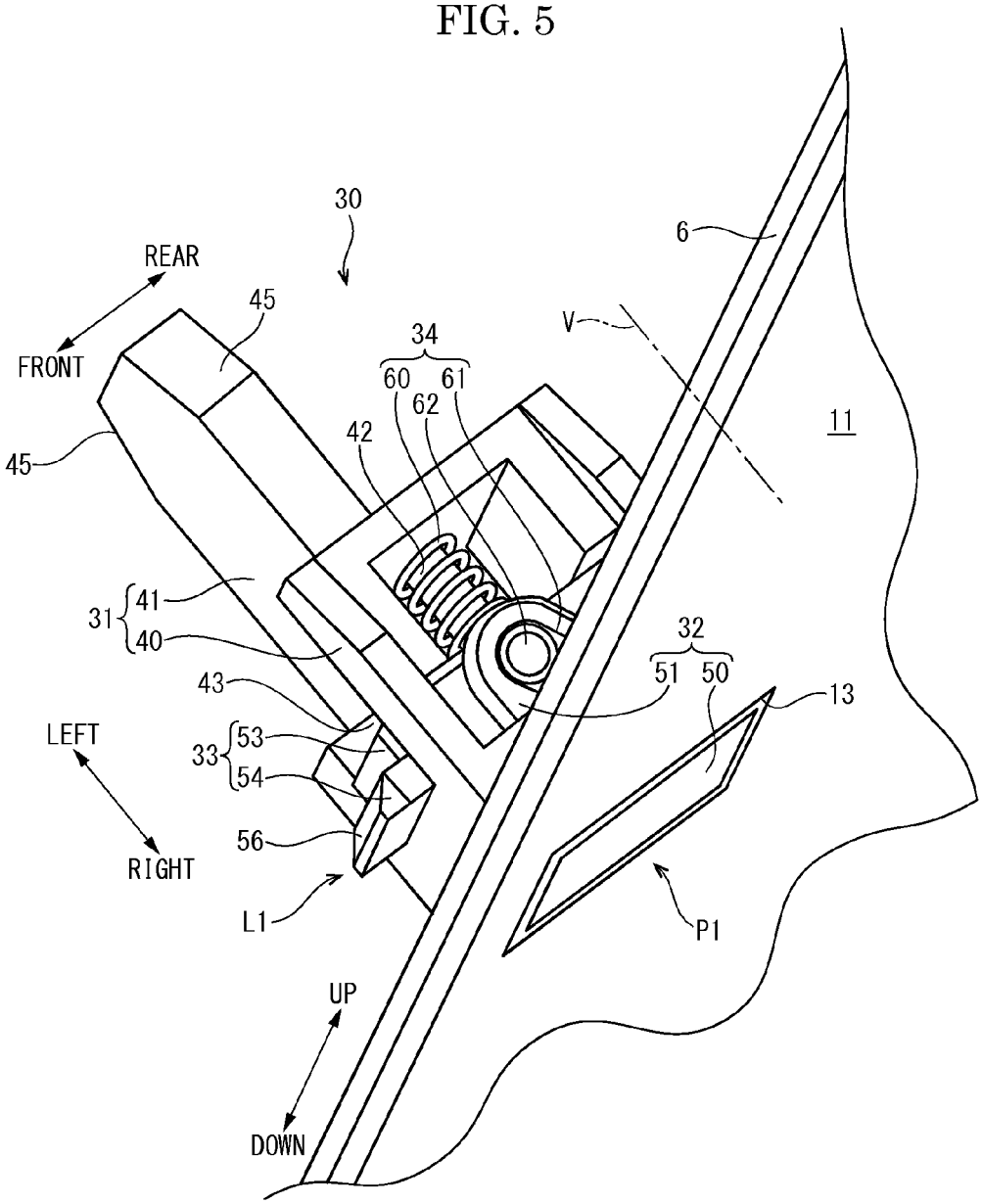
FIG. 5 is a perspective view illustrating a lock mechanism of the cover opening/closing device of one embodiment of the present disclosure.
Figure 6:
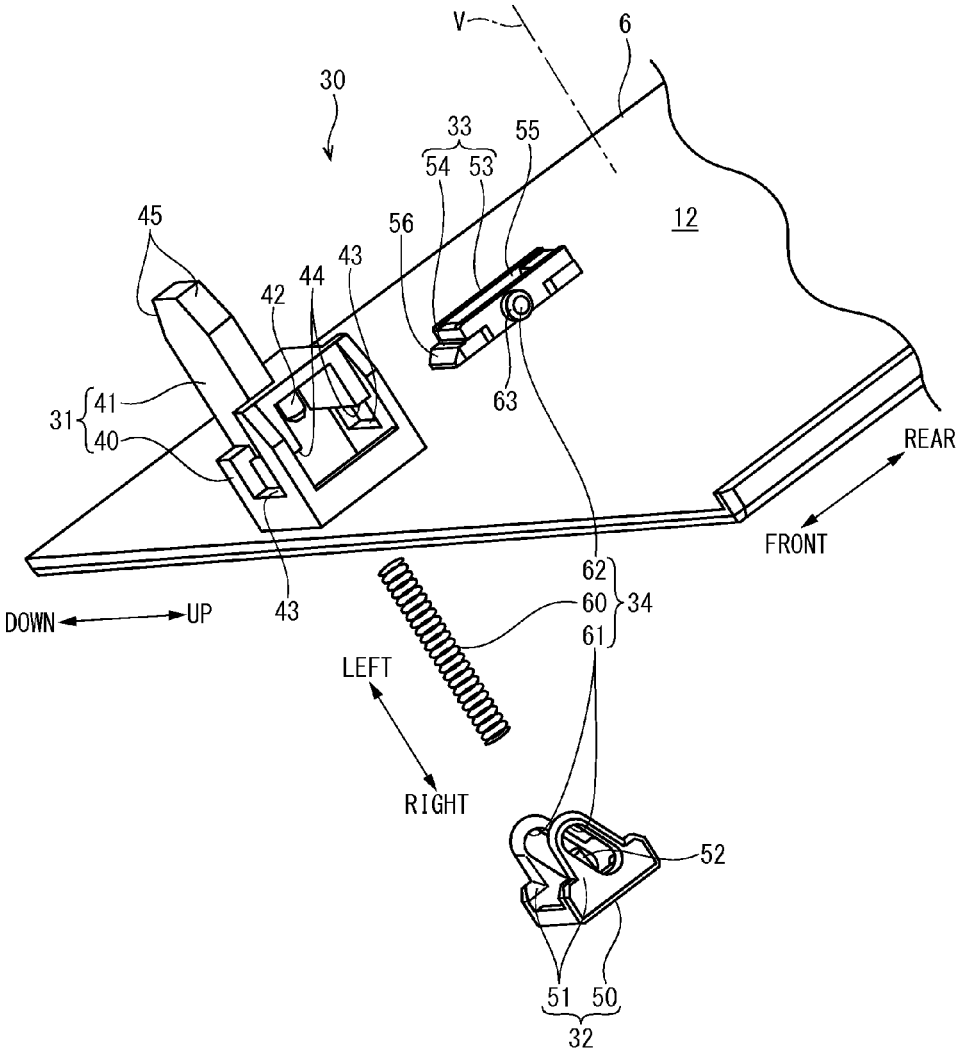
FIG. 6 is an exploded perspective view illustrating the lock mechanism of the cover opening/closing device of one embodiment of the present disclosure.
Figure 7:
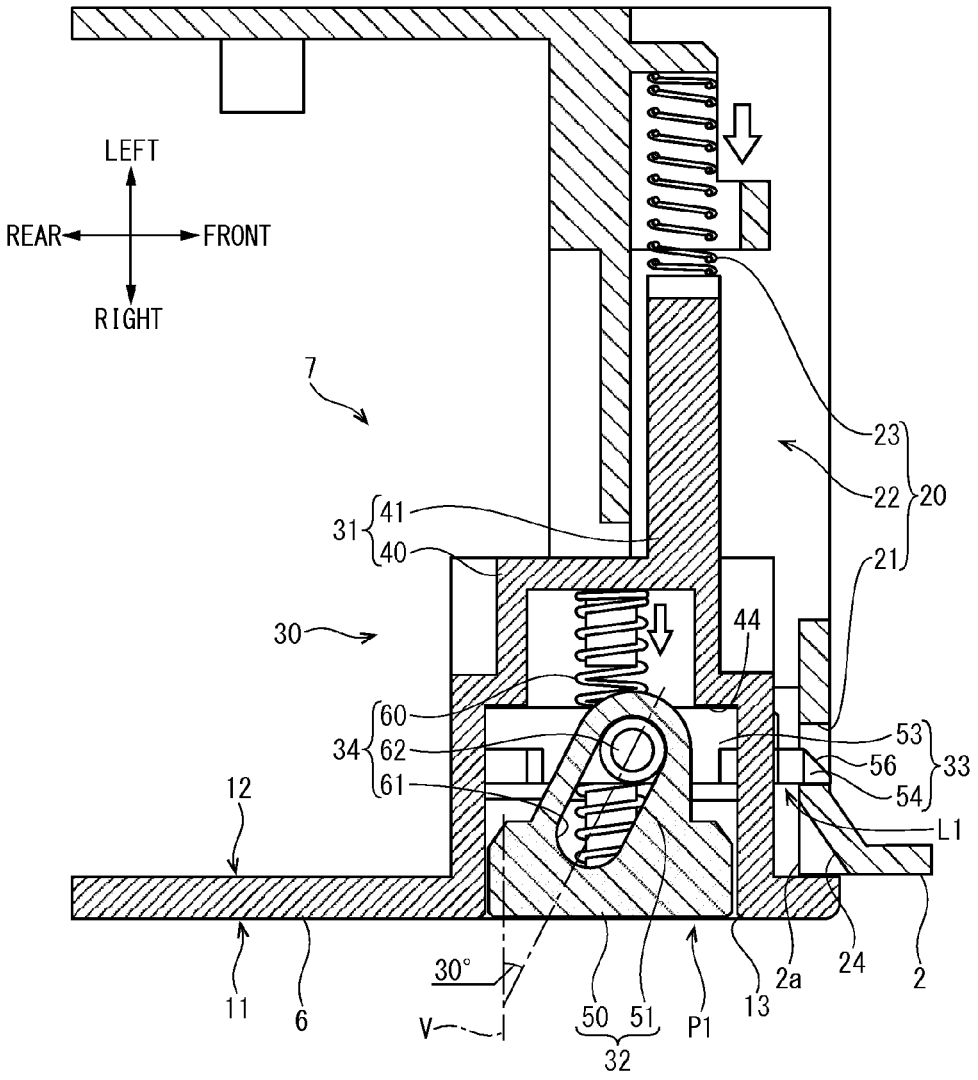
FIG. 7 is a section view taken along a line VII-VII in FIG. 1.
Figure 8:
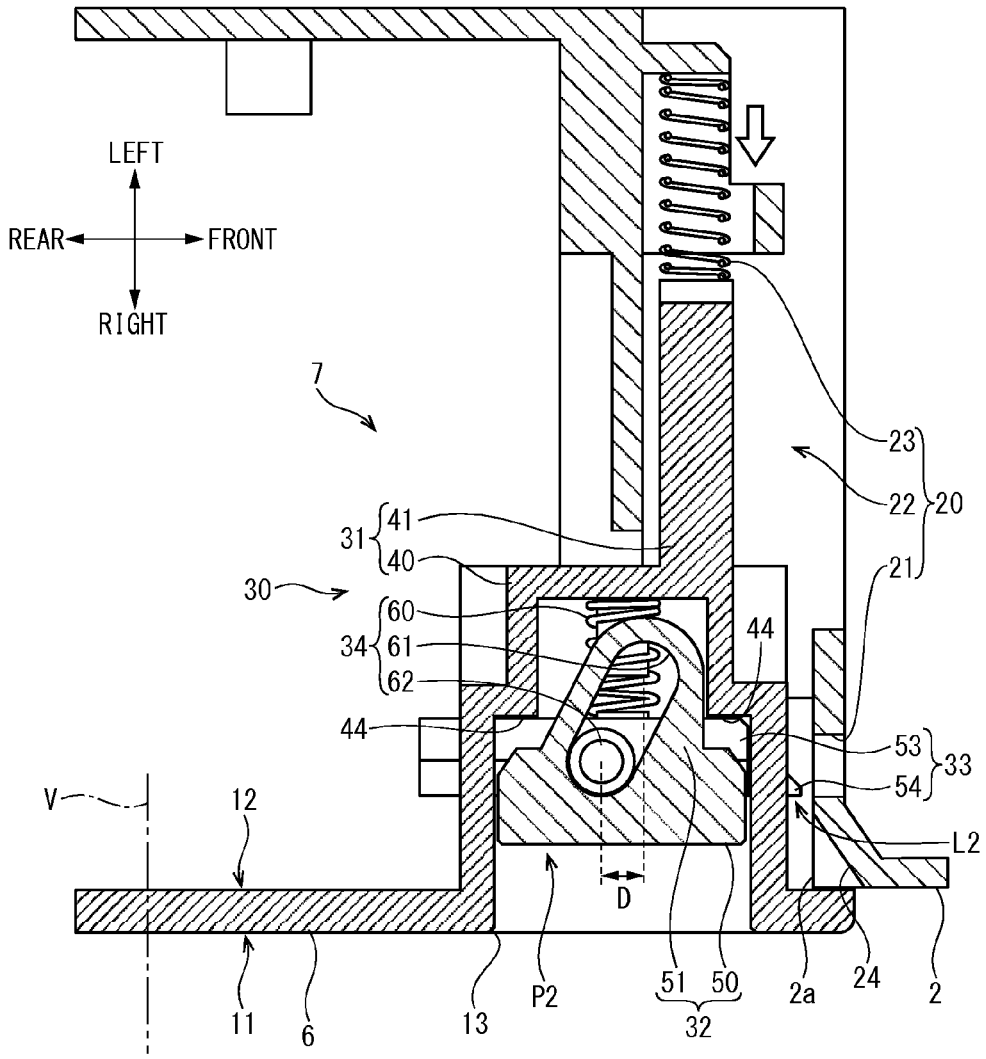
FIG. 8 is a section view illustrating a state in which a button in FIG. 7 is depressed.

The cover opening/closing device 7 will be described in detail below with reference to FIGS. 2 through 8. FIG. 3 is a perspective view illustrating an engage mechanism 20 of the cover opening/closing device 7. FIG. 4 is a section view taken along a line IV-IV in FIG. 1. FIG. 5 is a perspective view illustrating a lock mechanism 30 of the cover opening/closing device 7. FIG. 6 is an exploded perspective view illustrating the lock mechanism 30 of the cover opening/closing device 7. FIG. 7 is a section view taken along a line VII-VII in FIG. 1. FIG. 8 is a section view illustrating a state in which a button 32 in FIG. 7 is depressed. It is noted that the respective directions are set based on a state in which the cover 6 is closed for convenience of the following description.

As shown in FIG. 2, the cover opening/closing device 7 includes the engage mechanism 20 and the lock mechanism 30. The engage mechanism 20 is disposed substantially at middle in a vertical direction of a right front part of the apparatus body 2. The lock mechanism 30 is disposed substantially at middle in the vertical direction of a front part of the cover 6.

As shown in FIGS. 3 and 4, the engage mechanism 20 includes an engage part 21, a fitting concave part 22 and an extrusion spring 23.

The engage part 21 is dented on an inner surface of a front edge part of the apparatus body 2 forming a container replacing opening 2*a*. A catching surface 24 inclined forward from the engage part 21 toward the right side (outer side) is formed on the front edge part of the apparatus body 2. The fitting concave part 22 is formed at a position facing the lock mechanism 30 when the cover 6 is closed. The fitting concave part 22 is provided with a sensor (not shown) detecting that the cover 6 is closed.

The extrusion spring 23, i.e., a bias member, is provided in the fitting concave part 22. The extrusion spring 23 is a so-called coil spring and is configured to elastically deform in the right-left direction while abutting its one end against a bottom surface of the fitting concave part 22. It is noted that while its detail will be described later, the extrusion spring 23 is configured such that another end thereof is capable of abutting against a part of the lock mechanism 30 fitted into the fitting concave part 22. That is, the extrusion spring 23 is provided to bias the cover 6 in an opening direction through the lock mechanism 30.

As shown in FIGS. 4 through 6, the lock mechanism 30 includes a lock housing 31, a button 32, a lock member 33, and an interlocking mechanism 34. The lock housing 31 is provided on a back surface 12 of the cover 6. The button 32 and the lock member 33 are held by the lock housing 31. The interlocking mechanism 34 is provided in the button 32 and the lock member 33.

The lock housing 31 includes a frame part 40 and a fitting piece part 41. The lock housing 31 is integrally molded on the back surface 12 of the cover 6 by a synthetic resin material for example.

The frame part 40 is formed substantially into a rectangular cylinder shape having rectangular openings at both upper and lower surfaces thereof. The frame part 40 is provided at a peripheral edge part of a rectangular button hole 13 penetrating from the back surface 12 of the cover 6 through the cover 6. That is, an outside of the cover 6 communicates with an inside of the frame part 40 through the button hole 13.

The frame part 40 has a cylindrical boss part 42 at a left inner surface (inner surface facing the back surface 12). The boss part 42 projects from the left inner surface of the frame part 40 toward the back surface 12 side (right side). Rectangular slide holes 43 are formed respectively through both front and rear walls of the frame part 40. It is noted the frame part 40 is stepped such that a left side part (part distant from the back surface 12) of the frame part 40 is formed narrowly in the front-rear direction. Therefore, inner surfaces of a pair of front and rear stepped parts are formed to be guide faces 44 flush with the left edge part of the respective slide holes 43 (see FIG. 4).

The fitting piece part 41 is formed substantially into a plate which is thin in the front-rear direction. The fitting piece part 41 extends from the front end part of the frame part 40 toward the left side. That is, the fitting piece part 41 extends along a normal line V of an appearance surface 11 of the cover 6 (or the back surface 12). The fitting piece part 41 is provided with tapered surfaces 45 formed by chamfering upper and lower corner parts of an edge part of the fitting piece part 41.

The button 32 includes a pressing surface part 50 and a pair of upper and lower extension parts 51. The button 32 is integrally molded by a synthetic resin material for example.

The pressing surface part 50 is formed into a rectangular plate when viewed from aside. The pressing surface part 50 is formed into a shape and size capable of fitting into the button hole 13. A cylindrical button-side boss part 52 extending toward the left side is provided substantially at center of a back surface of the pressing surface part 50. The pair of upper and lower extension parts 51 extends toward the left side from both upper and lower ends of the pressing surface part 50. That is, the button 32 is formed substantially into a shape of letter U in a front view. The respective extension parts 51 are formed substantially into a triangular shape in a front view.

The button 32 penetrates through the button hole 13 from the appearance surface 11 side of the cover 6 and is held within the frame part 40 of the lock housing 31. As shown in FIGS. 7 and 8, the button 32 is provided so as to be able to move linearly in the normal line direction of the appearance surface 11 of the cover 6 between an initial position P1 and a depressed position P2. When the button 32 is located at the initial position P1, the pressing surface part 50 is disposed within the button hole 13 and is substantially in flush with the appearance surface 11 of the cover 6 (see FIG. 7). If the pressing surface part 50 is depressed, the button 32 moves linearly from the initial position P1 to the depressed position P2 (see FIG. 8).

As shown in FIGS. 4 through 6, the lock member 33 includes a frame-like part 53 and a claw part 54. The lock member 33 is integrally molded by a synthetic resin material for example.

The frame-like part 53 is formed substantially into a rectangular cylinder shape having a through opening 55 at center thereof (see FIG. 6). The claw part 54 projects toward the front side from a front end surface of the frame-like part 53. The claw part 54 is disposed on the right side (outer side) of the front end surface of the frame-like part 53 and has a step between the front end surface of the frame-like part 53. An inclined surface 56 is formed by chamfering a left corner part of an edge part of the claw part 54.

The lock member 33 penetrates through a pair of front and rear slide holes 43 opened through the frame part 40 and is held within the frame part 40. As shown in FIGS. 7 and 8, the lock member 33 is provided so as to be able to move linearly in a direction in parallel with the appearance surface 11 between a lock position L1 where the lock member 33 is engageable with the engage mechanism 20 (engage part 21) and an unlock position L2 where the lock member 33 is disengaged from the engage part 21.

As shown in FIGS. 4 through 6, the interlocking mechanism 34 includes a return spring 60, a pair of upper and lower oblique grooves 61 and a pair of upper and lower projection parts 62. The interlocking mechanism 34 is configured so as to interlock a movement of the lock member 33 with a movement of the button 32.

The return spring 60, i.e., a return member, is a so-called coil spring and is disposed between the lock housing 31 and the button 32. One end part of the return spring 60 fits into the boss part 42 of the frame part 40 and another end part of the return spring 60 fits into a button-side boss part 52 of the pressing surface part 50. The return spring 60 exerts a bias force (return force) on the button 32 such that the button 32 returns to the initial position P1. It is noted that the extrusion spring 23 described above has a bias force greater than the bias force (return force) of the return member.

The pair of upper and lower oblique grooves 61 is provided through the pair of upper and lower extension parts 51 of the button 32. Each oblique groove 61 is formed so as to penetrate through the extension part 51 in the vertical direction. As shown in FIG. 7, each oblique groove 61 extends aslant with respect to the normal line V of the appearance surface 11. Specifically, each oblique groove 61 is formed so as to incline forward from the right side (outer side) to the left side (inner side). More specifically, each oblique groove 61 is inclined by about 30 degrees with respect to the normal line V (60 degree with respect to the appearance surface 11 of the cover 6).

As shown in FIGS. 5 and 6, the pair of upper and lower projection parts 62 is provided so as to project from both upper and lower surfaces of the lock member 33. Each projection part 62 is formed into a columnar shape having a tapered part 63 at a projecting edge part thereof (see FIG. 6). Each projection part 62 is provided projectively so as to fit movably along the oblique groove 61.

Next, a procedure for assembling the lock mechanism 30 will be described with reference to FIGS. 4 through 6.

At first, an operator penetrates the lock member 33 through the pair of front and rear slide holes 43 to hold the lock member 33 by the frame part 40. Next, the operator puts the return spring 60 through the button hole 13 of the cover 6 and through the through opening 55 of the lock member 33 and fits one end part of the return spring 60 around the boss part 42 of the frame part 40. It is noted that the other end part of the return spring 60 extends outside through the button hole 13.

Next, the operator fits the other end part of the return spring 60 around the button-side boss part 52 of the button 32. While compressing the return spring 60, the operator advances the button 32 into the frame part 40 through the button hole 13. Then, the pair of upper and lower extension parts 51 of the button 32 abuts against the respective projection parts 62 provided projectively in the lock member 33. When the button 32 is advanced further, the pair of upper and lower extension parts 51 come into slidable contact with the tapered parts 63 of the respective projection parts 62 and elastically deform so as to extend in the vertical direction. Then, when the button 32 advances until to a position where the respective projection parts 62 can fit into the respective oblique grooves 61, the respective extension parts 51 are elastically deformed (restored) to its original state. In this state, the respective projection parts 62 fit into the oblique grooves 61 and the button 32 is held within the frame part 40. Thereby, the assembling process of the lock mechanism 30 is completed.

Next, an operating for opening and closing the cover 6 by the cover opening/closing device 7 will be described. At first, a state in which the cover 6 is closed will be described with reference to FIG. 7.

The button 32 is biased to the initial position P1 by the return spring 60 in the state in which the cover 6 is closed. Each projection part 62 provided projectively in the lock member 33 is held by the left end part (inner side) of the oblique groove 61 by the bias force (return force) of the return spring 60. In this state, the claw part 54 of the lock member 33 enters and engages with the engage part 21 of the engage mechanism 20. That is, the lock member 33 is held at the lock position L1 by the bias force of the return spring 60.

Meanwhile, in the state in which the cover 6 is closed, the lock housing 31 of the lock mechanism 30 fits in the fitting concave part 22 of the engage mechanism 20. The extrusion spring 23 of the engage mechanism 20 is compressed by the fitting piece part 41 of the lock housing 31. It is noted that another end part of the extrusion spring 23 abuts against the edge surface of the fitting piece part 41. In this state, while the cover 6 is biased by the extrusion spring 23 through the lock mechanism 30, the closed condition is kept because the claw part 54 is engaged with the engage part 21. That is, the cover 6 is locked. It is noted that the upper tapered surface 45 of the fitting piece part 41 actuates a sensor. This arrangement makes it possible for a control unit (not shown) connected with the sensor to detect the closure of the cover 6.

Next, a case where the cover 6 is opened from the state in which the cover 6 is closed will be described with reference to FIG. 8.

At first, a user depresses the button 32 in the normal line direction by resisting against the bias force of the return spring 60. That is, the user 32 depresses the button 32 from the initial position P1 to the depressed position P2. Then, each projection part 62 moves relatively obliquely right rearward by being guided by the oblique groove 61 and arrives at the right end part (outer side) of the oblique groove 61. Actually, each projection part 62 moves rearward by a front and rear difference D of the both right and left parts of the oblique groove 61. Accordingly, the lock member 33 in which each projection part 62 is projectively provided also moves rearward by being guided by each slide hole 43 and each guide surface 44 and disengages the claw part 54 from the engage part 21. That is, a state in which the lock member 33 moves to the unlock position L2 is brought about.

If the user weakens the force pressing the button 32 in this state, the extrusion spring 23 presses the cover 6 in the opening direction before the return spring 60 returns the button 32 to the initial position P1, because the extrusion spring 23 on the apparatus body 2 side has the bias force stronger that the bias force (return force) of the return spring 60 that returns the button 32. This arrangement makes it possible to smoothly carry out the opening operation of the cover 6 even if the cover 6 is lightly pressed through the button 32. Thus, the cover 6 turns centering on the respective turning shafts 10 and is opened (see FIG. 2).

By the way, when the user releases his hand (finger) completely from the button 32, the button 32 returns from the depressed position P2 to the initial position P1 by the return spring 60 (see FIG. 7). Then, the lock member 33 operates reversely from the abovementioned opening operation. That is, each projection part 62 moves relatively obliquely left forward by being guided by the oblique groove 61 and arrives at the left end part of the oblique groove 61. Accordingly, the lock member 33 in which each projection part 62 is projectively provided also moves forward by the front and rear difference D. That is, the state in which the lock member 33 has moved to the lock position L1 is brought about. It is noted that the lock position L1 refers not only the position where the lock member 33 (the claw part 54) is actually engaged with the engage part 21, but also a position where the lock member 33 is engaged with the engage part 21 when the cover 6 is closed even if it is a state in which the lock member 33 is disengaged.

As described above, each oblique groove 61 guides the relative movement of each projection part 62 so as to interlock the depressing operation of the button 32 located at the initial position P1 with the movement of the lock member 33 heading toward the unlock position L2. In the same manner, each oblique groove 61 guides the relative movement of each projection part 62 so as to interlock the button returning operation by the return spring 60 with the movement of the lock member 33 heading toward the lock position L1.

Next, a case when the cover 6 is closed from the state in which the cover 6 is opened will be described with reference to FIG. 7.

At first, the user turns the cover 6 in a closing direction. Then, the inclined face 56 of the claw part 54 abuts against the catching surface 24 formed on the front edge part of the apparatus body 2. When the cover 6 is turned further, the claw part 54 (the inclined face 56) slides on the catching surface 24, and the lock member 33 is moved rearward. Therefore, each projection part 62 projectively provided moves relatively along the oblique groove 61. That is, the button 32 moves in the depressing direction from the initial position P1 by resisting against the bias force of the return spring 60 in linkage with the movement of the lock member 33.

Then, in response to the turn of the cover 6 to the position where the claw part 54 can fit into the engage part 21, the button 32 returns to the initial position P1 by the bias force of the return spring 60. Because each projection part 62 moves relatively along the oblique groove 61 in linkage with this return operation, the lock member 33 moves to the lock position L1. That is, the claw part 54 is engaged with the engage part 21, and the cover 6 is locked.

According to the cover opening/closing device 7 of the embodiment described above, the reciprocal movement of the button 32 along the normal line V is converted into the reciprocal movement of the lock member 33 along the appearance surface 11 through each projection part 62 relatively and obliquely moving by being guided by each oblique groove 61. The return spring 60 has the functions of returning the button 32 to the initial position P1 and of holding the lock member 33 at the lock position L1. This arrangement makes it possible to downsize the cover opening/closing device 7 and to cut a number of components because it is possible to eliminate a dedicated spring and others for holding the lock member 33 at the lock position L1 for example. Still further, it is possible to downsize the color printer 1 by adopting the downsized and simplified cover opening/closing device 7.

Still further, according to the cover opening/closing device 7 of the present embodiment, the cover 6 is pushed out in the opening direction by the bias force of the extrusion spring 23 because the lock member 33 is moved to the unlock position L2. This arrangement makes it possible to automatically open the cover 6 by interlocking with the release of the lock.

According also to the cover opening/closing device 7 of the present embodiment, each projection part 62 relatively moves smoothly along the oblique groove 61 by setting the angle formed between the appearance surface 11 and each oblique groove 61 at 60 degrees. It is noted that while the angle formed between the appearance surface 11 and each oblique groove 61 is set at 60 degrees in the cover opening/closing device 7 of the present embodiment, the present disclosure is not limited to such angle. Each oblique groove 61 may be formed so as to incline with respect the appearance surface 11 within a range of more than 60 degrees and less than 90 degrees.

Still further, while the cover opening/closing device 7 of the present embodiment is configured such that the engage mechanism 20 is provided in the apparatus body 2 and the lock mechanism 30 is provided in the cover 6, the present disclosure is not limited to such configuration. For instance, the lock mechanism 30 may be provided in the apparatus body 2 and the engage mechanism 20 may be provided in the cover 6. That is, the engage mechanism 20 may be provided in ether one of the apparatus body 2 and the cover 6, and the lock mechanism 30 may be provided in either other one of the apparatus body 2 and the cover 6.

Figure 9:
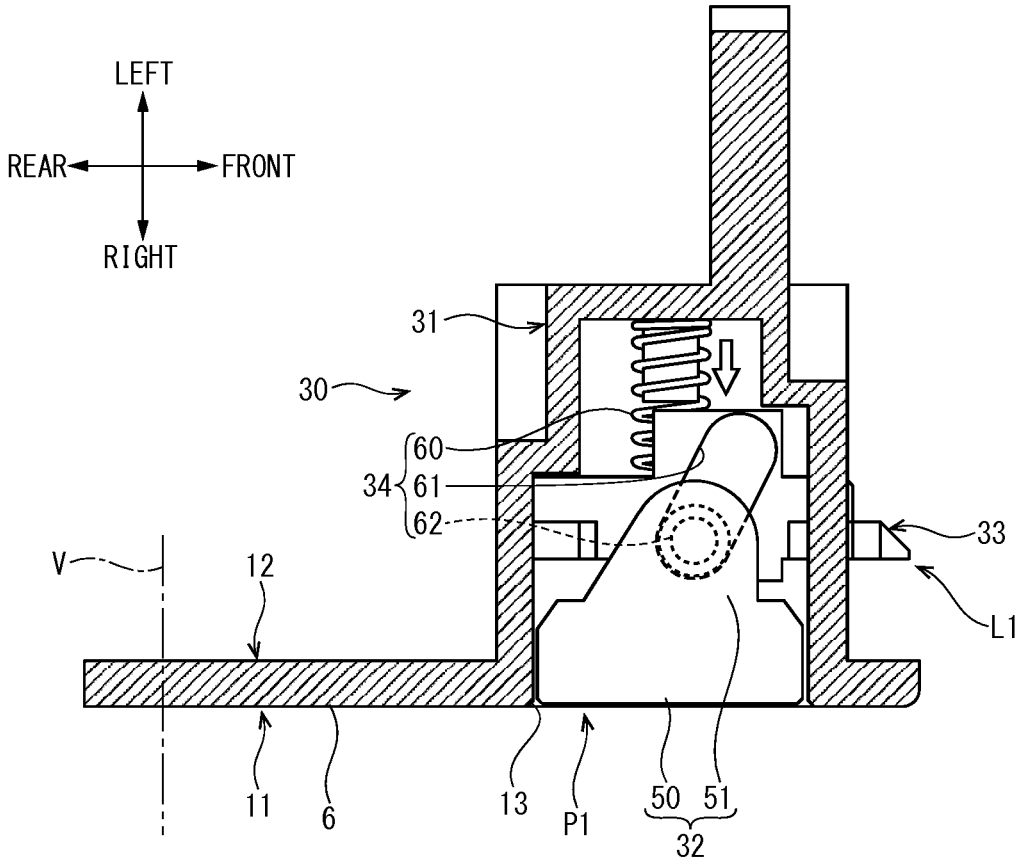
FIG. 9 is a section view illustrating a lock mechanism of a cover opening/closing device of a modified example of one embodiment of the present disclosure.

It is also noted that while each oblique groove 61 is provided in the button 32 and each projection part 62 is provided in the lock member 33, the present disclosure is not limited to such configuration. For instance, each projection part 62 may be provided in the button 32 and each oblique groove 61 may be provided in the lock member 33 as shown in FIG. 9. The cover opening/closing device of this case also operates in the same manner with the cover opening/closing device 7 described above. That is, the oblique groove 61 may be provided in either one of the button 32 and the lock member 33, and the projection part 62 may be provided in either other one of the button 32 and the lock member 33.

It is noted that while the cover 6 is provided on the right side surface of the apparatus body 2 in the color printer 1 of the present embodiment, the present disclosure is not limited to such configuration. The cover 6 may be provided at either side surface of front, rear, right and left surfaces and the upper surface of the apparatus body 2. Still further, the cover 6 is not limited to be the rectangular cover but may be formed into a polygonal shape or a circular shape, other than the rectangular shape. Still further, while the pair of upper and lower turning shafts 10 are provided at the rear part of the cover 6 in the present embodiment, the present disclosure is not limited to such configuration as long as one or more turning shafts are provided on any one side of a circumference of the cover 6.

Still further, the case in which the present disclosure is applied to the color printer 1 as one example has been described in the present embodiment, the present disclosure is not limited to such case, and the present disclosure is applicable also to other electronic devices such as a monochrome printer, facsimile, a multi-functional peripheral, and the like.

While the preferable embodiment and its modified example of the cover opening/closing device and the image forming apparatus including this of the present disclosure have been described above and various technically preferable configurations have been illustrated, a technical range of the disclosure is not to be restricted by the description and illustration of the embodiment. Further, the components in the embodiment of the disclosure may be suitably replaced with other components, or variously combined with the other components. The claims are not restricted by the description of the embodiment of the disclosure as mentioned above.

What is claimed is:

1. A cover opening/closing device, comprising:

an engage mechanism provided at either one of an apparatus body and a turning cover centering a turning shaft with respect to the apparatus body; and a lock mechanism provided on either other one of the apparatus body and the cover;

the lock mechanism including:

a button provided to be able to move linearly in a normal line direction of an appearance surface of the either other one of the apparatus body and the cover;

a lock housing holding the button;

a lock member provided to be able to move linearly in a direction in parallel with the appearance surface between a lock position where the lock member is engaged with the engage mechanism and an unlock position where the lock member is disengaged; and an interlocking mechanism interlocking a movement of the button with a movement of the lock member;

the lock member includes a through opening at a center part thereof, the interlocking mechanism including:

a return member returning the button to an initial position;

an oblique groove provided at either one of the button and the lock member and extending obliquely with respect to a normal line of the appearance surface; and a projection part provided in either other one of the button and the lock member and fitting movably inside the oblique groove;

the return member penetrates through the through opening of the lock member and is disposed between the lock housing and the button, the oblique groove causing a relative movement of the projection part so as to interlock a pressing operation of the button located at the initial position with a movement of the lock member heading to the unlock position and causing a relative movement of the projection part so as to interlock a return operation of the button caused by the return member with a movement of the lock member heading to the lock position.

2. The cover opening/closing device according to claim 1, wherein the engage mechanism includes a bias member biasing the cover in an opening direction.

3. The cover opening/closing device according to claim 2, wherein the engage mechanism is provided in the apparatus body, the lock mechanism is provided in the cover, and the bias member biases the cover with a force greater than a return force of the return member.

4. The cover opening/closing device according to claim 1, wherein the button includes a pressing surface part in flush with the appearance surface in a case when the button is located at the initial position and a pair of extension parts extending from both end parts of the pressing surface part in a depressing direction of the button, the pair of extension parts is provided with a pair of either one of the oblique grooves and the projection parts, and the lock member is provided with a pair of either other one of the oblique grooves and the projection parts.

5. The cover opening/closing device according to claim 1, wherein the oblique groove is formed so as to incline in a range of more than 60 degrees and less than 90 degrees with respect to the appearance surface.

6. An image forming apparatus, comprising:

an image forming part performing an image forming process; and a cover opening/closing device;

the cover opening/closing device including:

an engage mechanism provided at either one of an apparatus body and a turning cover centering a turning shaft with respect to the apparatus body; and a lock mechanism provided on either other one of the apparatus body and the cover;

the lock mechanism including:

a button provided to be able to move linearly in a normal line direction of an appearance surface of the either other one of the apparatus body and the cover;

a lock housing holding the button;

a lock member provided to be able to move linearly in a direction in parallel with the appearance surface between a lock position where the lock member is engaged with the engage mechanism and an unlock position where the lock member is disengaged; and an interlocking mechanism interlocking a movement of the button with a movement of the lock member;

the lock member includes a through opening at a center part thereof, the interlocking mechanism including:

a return member returning the button to an initial position;

an oblique groove provided at either one of the button and the lock member and extending obliquely with respect to a normal line of the appearance surface; and a projection part provided in either other one of the button and the lock member and fitting movably inside the oblique groove;

the return member penetrates through the through opening of the lock member and is disposed between the lock housing and the button, the oblique groove causing a relative movement of the projection part so as to interlock a pressing operation of the button located at the initial position with a movement of the lock member heading to the unlock position and causing a relative movement of the projection part so as to interlock a return operation of the button caused by the return member with a movement of the lock member heading to the lock position.

* * * * *